US010508450B2

(12) United States Patent
Thompson et al.

(10) Patent No.: US 10,508,450 B2
(45) Date of Patent: Dec. 17, 2019

(54) KICK OUT FLASHING

(71) Applicants: Leon W. Thompson, Kent City, MI (US); Nathan L. Thompson, Grant, MI (US); Jacob M. Thompson, Grant, MI (US)

(72) Inventors: Leon W. Thompson, Kent City, MI (US); Nathan L. Thompson, Grant, MI (US); Jacob M. Thompson, Grant, MI (US)

(73) Assignee: American Flashings and Accessories, LLC, Bailey, MI (US)

( * ) Notice: Subject to any disclaimer, the term of this patent is extended or adjusted under 35 U.S.C. 154(b) by 0 days.

(21) Appl. No.: 16/162,938

(22) Filed: Oct. 17, 2018

(65) Prior Publication Data

US 2019/0161973 A1 May 30, 2019

Related U.S. Application Data

(60) Provisional application No. 62/591,946, filed on Nov. 29, 2017.

(51) Int. Cl.

| | |
|---|---|
| ***E04D 13/147*** | (2006.01) |
| ***E04D 13/04*** | (2006.01) |
| *E04D 1/36* | (2006.01) |

(52) U.S. Cl.

CPC ..... *E04D 13/1478* (2013.01); *E04D 13/04* (2013.01); *E04D 13/0459* (2013.01); *E04D 13/0481* (2013.01); *E04D 1/36* (2013.01); *E04D 2013/0468* (2013.01); *E04D 2013/0486* (2013.01)

(58) Field of Classification Search

CPC ... E04D 13/0481; E04D 13/0459; E04D 1/36; E04D 2013/0468; E04D 2013/0486; E04D 13/1478; E04D 13/04

See application file for complete search history.

(56) References Cited

U.S. PATENT DOCUMENTS 2,112,332 A * 3/1938 Cox ..... E04D 13/1478 52/59

3,533,201 A 10/1970 Tyler (Continued)

FOREIGN PATENT DOCUMENTS

EP 0410692 A1 * 1/1991 ..... E04B 1/644

EP 1424455 A1 * 6/2004 ..... E04D 13/1475

*Primary Examiner* — Jessie T Fonseca

(74) *Attorney, Agent, or Firm* — Warner Norcross + Judd LLP

(57) ABSTRACT

A kick out flashing includes a base for placement adjacent a roof, a sidewall for placement adjacent a wall by the roof, a first kick out wall angled away from the sidewall, an intermediate wall joined with the first kick out wall, distal from and optionally parallel to the sidewall, and a second kick out wall angled away from the intermediate wall, the second kick out wall distal from the sidewall and downstream from the first kick out wall. The sidewall, intermediate wall and a bottom wall can form a channel that receives a J channel or other wall covering. The first kick out wall can prevent water from traveling directly under the bottom wall and/or the channel, diverting it away from the sidewall. The second kick out wall can further divert water away from the channel and/or sidewall.

20 Claims, 5 Drawing Sheets

(56) References Cited

U.S. PATENT DOCUMENTS

| | | | | | |
|---|---|---|---|---|---|
| 3,698,142 | A * | 10/1972 | Theriault | E04D 13/1475 | 52/556 |
| 5,109,641 | A | 5/1992 | Halan | | |
| 5,333,419 | A | 8/1994 | Hickner | | |
| 5,673,520 | A * | 10/1997 | Yannucci, III | E04D 13/1475 | 285/42 |
| 5,675,939 | A | 10/1997 | Hickner | | |
| 6,401,402 | B1 | 6/2002 | Williams | | |
| 6,481,164 | B1 | 11/2002 | McCorkel | | |
| 6,681,530 | B1 | 1/2004 | Givens | | |
| 6,725,617 | B2 | 4/2004 | Cox | | |
| 7,219,477 | B2 | 5/2007 | Leffler | | |
| 7,451,571 | B2 * | 11/2008 | Allen | E04D 13/1478 | 52/13 |
| 7,685,779 | B1 | 3/2010 | Nelson | | |
| 8,161,689 | B1 * | 4/2012 | Butzen | E06B 1/62 | 52/58 |
| D844,182 | S * | 3/2019 | Folkersen | D25/199 | |
| 2003/0046878 | A1 * | 3/2003 | Zdeb | E04D 3/40 | 52/58 |
| 2004/0148871 | A1 * | 8/2004 | Fandel | E04D 13/1478 | 52/58 |
| 2004/0226225 | A1 | 11/2004 | Olk et al. | | |
| 2009/0277102 | A1 * | 11/2009 | Bishop | E04D 3/38 | 52/58 |
| 2016/0376791 | A1 * | 12/2016 | Givens | E04D 13/1478 | 52/62 |
| 2017/0342716 | A1 * | 11/2017 | Sinclair | E04D 13/0481 | |

* cited by examiner

KICK OUT FLASHING

BACKGROUND OF THE INVENTION

The present invention relates to a construction device, and more particularly to a kick out flashing installable on a roof adjacent a side wall or edge to divert water along a predetermined path.

In the construction industry, it is a common objective to ensure that structures are weatherproof. This can be challenging, particularly on portions of the structure adjacent a roof. For example, at the interface between a sloped roof and a vertical wall, the roof deck typically terminates against and abuts the vertical wall. In an attempt to provide a water barrier at the interface of the wall and the roof, a section of flashing is installed, typically along the entire interface. This flashing usually is constructed from two planar sections bent in an L shape. One section, the vertical leg, is positioned under the siding and affixed to the wall, while the other section, the base, is positioned under shingles and over the roof deck. The flashing is placed at the interface of the roof and the wall to prevent water from entering the building there.

An issue with such flashing is that water often will flow around the end of the vertical leg of the flashing, behind it and sometimes under siding on the wall. Further, where the water flows off the end of the roof and the flashing, it typically flows along the vertical wall, sometimes penetrating behind siding on that wall. To address this issue, a small length of the vertical leg of the flashing is separated from the base and bent outward so as to create a single kick out plate with that bent portion of the vertical leg. This plate kicks water flowing down the shingles away from the wall to reduce the amount of water that runs down the wall and off the end of the roof.

While this solution is helpful, sometimes roofers forget to modify the flashing to create the kick out plate. In addition, if the kick out plate is not properly constructed or is not cut properly, it can in some cases actually divert water back toward the wall or structure, causing more water damage. Further, when a siding installer later installs siding over the flashing above the roof deck on the wall, the installer typically will install a J channel to start the siding up the wall. Many siding installers are unfamiliar with the function of the kick out plate installed by roofers, so to accommodate the J channel, the installers will simply cut off a portion or all of the kick out plate, thereby defeating its intended purpose of diverting water.

Accordingly, there remains room for improvement in the field of kick out flashing used in construction applications.

SUMMARY OF THE INVENTION

A kick out flashing is provided to divert water flowing on a roof along a predetermined path away from a structure, such as a wall.

In one embodiment, the kick out flashing includes a base for placement adjacent a roof, a sidewall for placement adjacent a wall bordering the roof, a first kick out wall angled away from the sidewall, an intermediate wall joined with the first kick out wall, and a second kick out wall angled away from the intermediate wall.

In another embodiment, the sidewall, intermediate wall and a bottom wall can form a channel that receives a siding J channel. The first kick out wall can prevent water from traveling directly under the bottom wall and/or the channel, diverting water away from the sidewall. The second kick out wall can divert water farther away from the channel and/or sidewall.

In a further embodiment, the first kick out wall can be distal from and optionally parallel to the sidewall. The second kick out wall can be distal from the sidewall and downstream from the first kick out wall. The first kick out wall can kick out water a first distance from the sidewall, and the second kick out wall can kick out water again, but at a second distance from the sidewall and/or intermediate wall.

In still another embodiment, the base can include a downstream end and an upstream end. The first kick out wall can be closer to the upstream end than the second kick out wall.

In even another embodiment, the channel can be bounded by the bottom wall extending between the intermediate wall and the sidewall. The bottom wall can transition to the first kick out wall at a channel interface, which optionally can be disposed at a first obtuse angle relative to the sidewall. Further optionally, the first kick out wall can be disposed at the first obtuse angle relative to the sidewall.

In yet another embodiment, the intermediate wall can transition to the second kick out wall, which can be disposed at a second obtuse angle relative to the sidewall and/or intermediate wall. Optionally, the second obtuse angle can be less than the first obtuse angle of the first kick out wall.

In a further embodiment, the first kick out wall can be of a first height and the second kick out wall can be of a second height that is greater than the first height.

In still a further embodiment, the sidewall transitions to the first kick out wall and the first kick out wall transitions to the intermediate wall. The intermediate wall can be substantially parallel to the sidewall and distal from the sidewall. The intermediate wall also can transition to the second kick out wall.

In yet a further embodiment, the intermediate wall is taller than the first kick out wall.

The current embodiments of the kick out flashing provide benefits in weather proofing walls and roof decks that previously have been unachievable.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
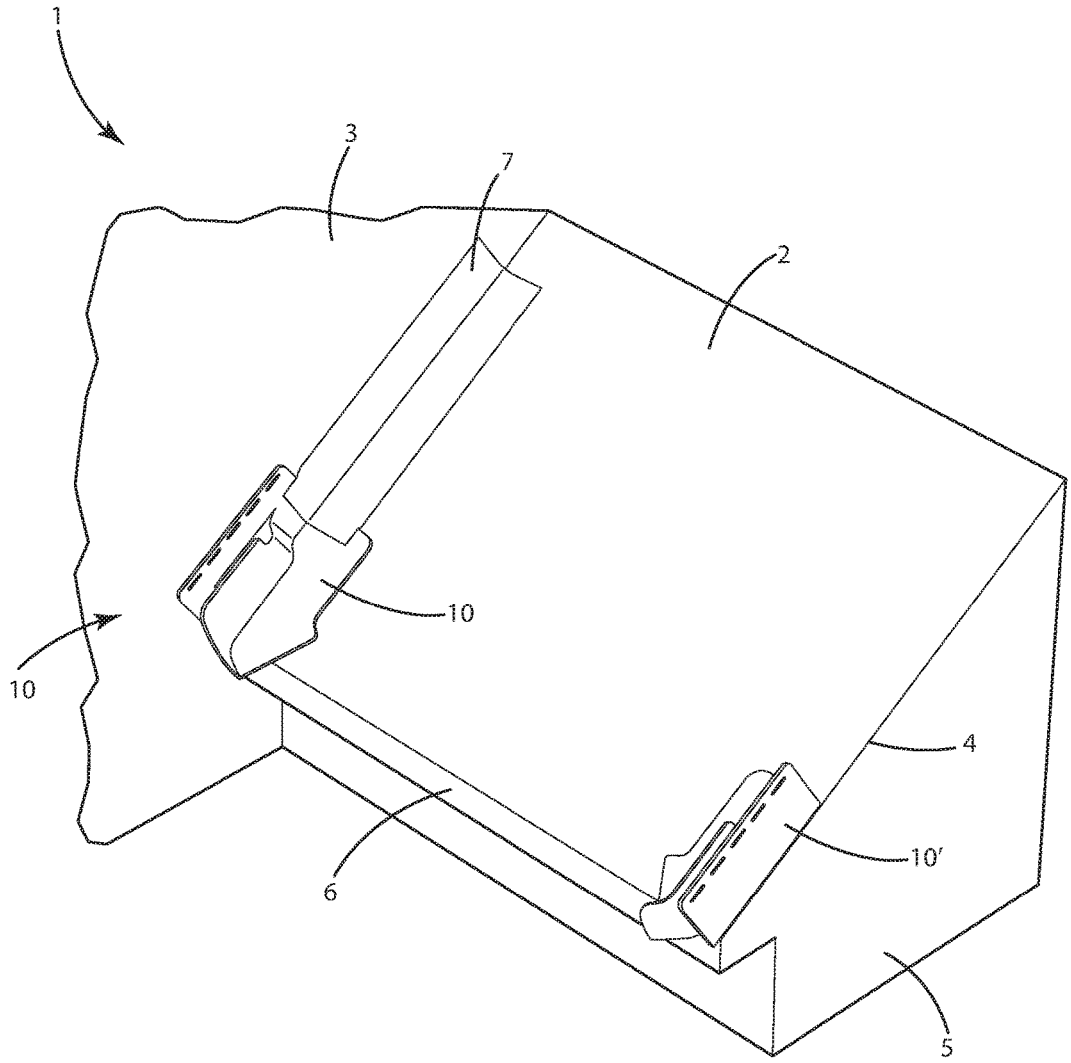
FIG. 1 is a perspective view of kick out flashing of a current embodiment installed on a roof deck adjacent a wall to divert water along a predetermined path.

A current embodiment of the kick out flashing is illustrated in FIGS. 1-8, and generally designated 10. The kick out flashing 10 can generally include a base 20, a sidewall 30, a first kick out wall 40, which transitions to intermediate wall 50, which transitions to a second kick out wall 60. In use, the base 20 can be at least partially covered by one or more shingles (not shown) that are applied to a structural roof deck 2 disposed adjacent and at an angle relative to a structural wall 3. The sidewall 30 can be placed adjacent the structural wall 3, optionally being fastened thereto via a fastener flange 31 defining a plurality of elongated slots that form openings 310. The sidewall 30, intermediate wall 50 and a bottom wall 71 collectively can form a channel 70, which is configured to receive a J channel or lowermost piece of siding or other wall covering J, (shown in FIG. 4), all of which are generally referred to as a J channel herein, which is configured to cover and/or extend along at least a portion of the structural wall 3.

The first kick out wall 40 can diverge water along a water path WP from a nominal distance D1 (which can be zero) to a greater distance D2 away from the sidewall 30, and out from under the channel 70 and bottom wall 71. The second kick out wall 60 can diverge water along the water path WP from the distance D2 away from the sidewall or generally away from the intermediate wall, to a distance D3, to sufficiently diverge the water path WP away from the vertical wall 3 or some other structure of the building 1.

It will be noted that the current embodiment of the kick out flashing 10 is described in connection with diverting water along a roof deck 2 away from a generally vertical wall 3. As shown in FIG. 1, however, the kick out flashing 10' optionally can be placed adjacent an edge along a roof deck or some other structure to divert water away from another wall or other surface of the building 1. In this configuration, the fastener flange optionally can be eliminated from the kick out flashing. It will be appreciated that the kick out flashing also can be placed elsewhere on the building 1, wherever the divergence of water away from a portion of the building is helpful. In addition, it will be noted that the kick out flashing can be formed in left-hand or right-hand configurations, depending on the direction of the water flow. This can be illustrated by comparing the kick out flashing 10 with the kick out flashing 10' shown in FIG. 1. Both left and right-hand configurations can have identical but mirror image features.

The kick out flashing 10 of the current embodiments can be constructed from a variety of materials. As shown, the kick out flashing is constructed from an injection molded polymer. Of course, the flashing can be constructed from other materials, such as composites, metal, resin and the like, or combinations thereof. In some cases, the flashing can be formed via extrusion rather than molding. When constructed from plastic, resin, or other polymers, the material of the kick out flashing can be constructed to be resistant to degradation by sunlight, weather and/or other elements. The material from which the kick out flashing is constructed also can be colored with a colorant in a suitable manner. The colorant can be incorporated into the material and/or specially formulated to prevent excessive fading due to sunlight or the elements. Further optionally, the kick out flashing can be formed so that all of its components form a monolithic, single piece unit. Of course, in some applications different components of the kick out flashing can be constructed separately so that those components and others can be joined together on site in certain applications.

Figure 2:
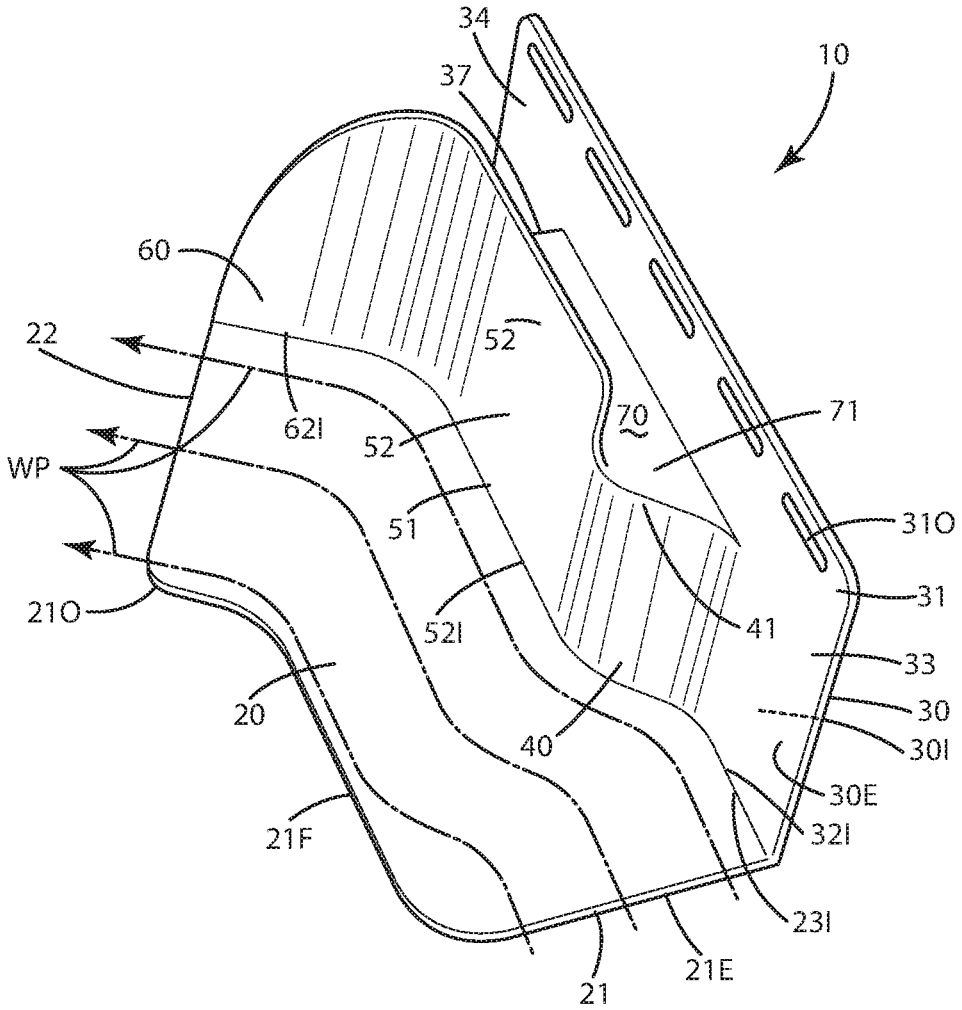
FIG. 2 is perspective view of the kick out flashing.
Figure 3:
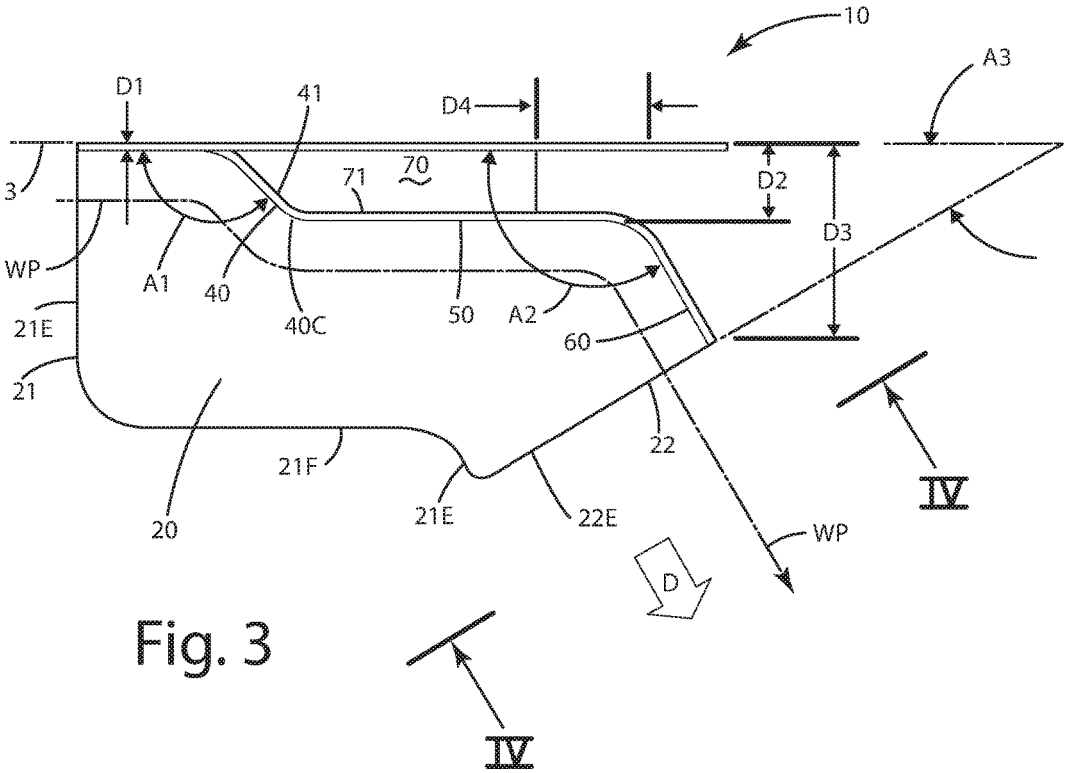
FIG. 3 is a top plan view of the kick out flashing.
Figure 4:
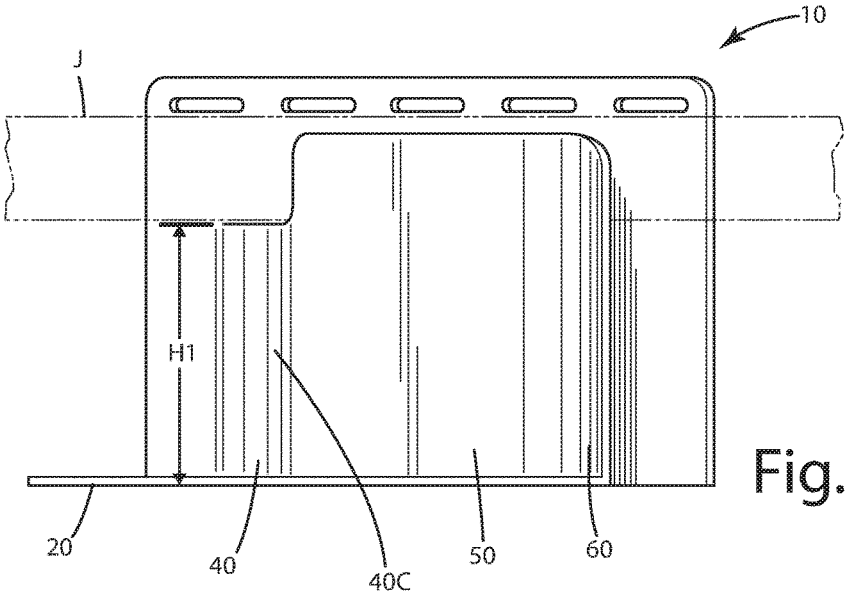
FIG. 4 is a perspective view of the kick out flashing taken from view 4-4 shown in FIG. 3.

The various components of the kick out flashing will now be described in further detail. To begin, the base 20 can be of a generally flat, planar configuration as shown in FIGS. 2-4. The base itself can be of a relatively low profile so that it can fit under shingles, tile, or other roof covering materials. The base 20 can include an upstream end 21 and a downstream end 22. The upstream end 21 can be distal from the downstream end 22 such that water flows along a water path WP from the upstream end 21 toward the downstream end 22. The upstream end 21 can include an edge 21E that, along with the base 20, can be generally perpendicular to the sidewall 30. For example, the edge 21E can be perpendicular in a vertical plane and optionally in a horizontal plane relative sidewall 30. The edge 21E can transition to a side edge 21F. This side edge 21F can be generally parallel to the sidewall 30 along a length of it. The side edge 21F can transition to an outward angled edge 21G which generally angles outward away from the sidewall 30. This outward angled edge 21G can transition to the edge 22E at the downstream end 22 of the base. This edge 22E can be disposed at an acute angle A3 relative to the sidewall 30 as shown in FIG. 3. Of course, in some applications, this edge 22E can be parallel to the sidewall 30.

The base 20 can be substantially planar. Of course, in some cases, it can include ribs, ridges, or other projections to assist in guiding or channeling the water along a water path WP, or to assist in the fastener securing the flashing to the roof and/or a roof covering. These ribs or ridges optionally can be parallel to the corresponding portions of the other components, for example, the sidewall, first kick out wall, intermediate wall and second kick out wall. Further, the base optionally can include one or more holes through which to place fasteners to secure the base 20 and thus the kick out flashing 10, to the roof 2.

The base can be joined with the sidewall 30, first kick out wall 40, intermediate wall 50 and second kick out wall 60 along a base interface 231. This base interface can be in the form of an angled or rounded corner. The corner can be sealed so that water does not penetrate under the aforementioned walls or portions of the kick out flashing 10. Optionally, the sidewall 30 can transition to the base 20 at a sidewall corner 321. The intermediate wall 50 can transition to the base 20 at an intermediate corner. The intermediate corner 521 can be farther away from the sidewall 30 than the sidewall corner 321, and optionally farther away from the upstream end 21 of the base 20 than the sidewall corner 321. The second kick out wall 60 also can transition to the base 20 at a second kick out wall interface 621, which can be farther from the upstream end 21 than the intermediate wall interface 521 and the sidewall interface 331.

Figure 6:
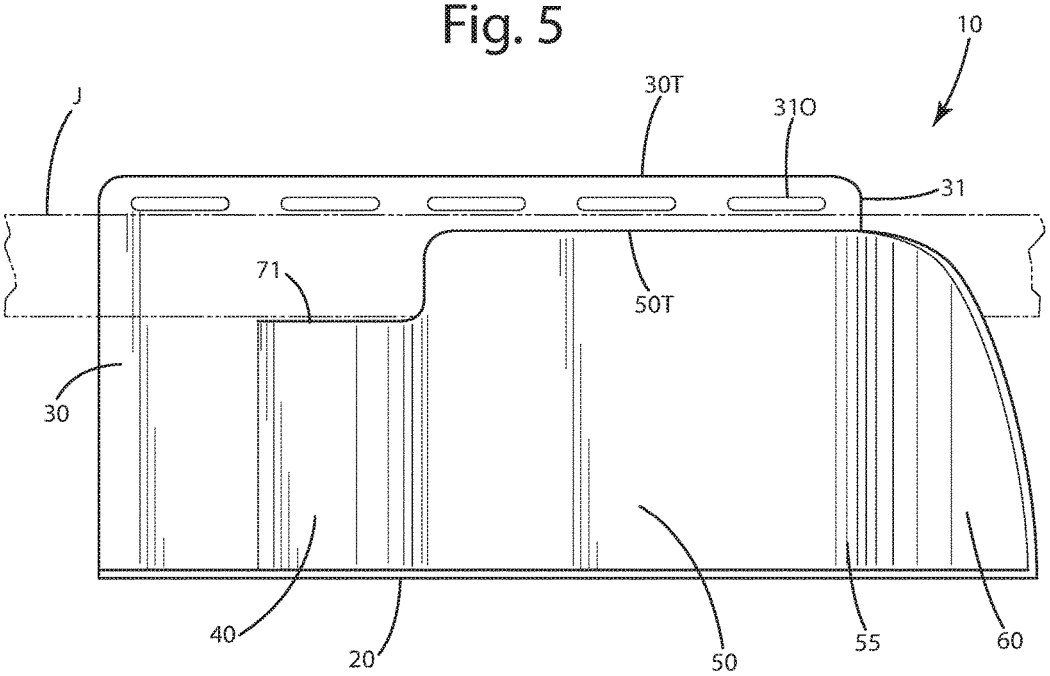
FIG. 6 is a right side view of the kick out flashing.
Figure 7:
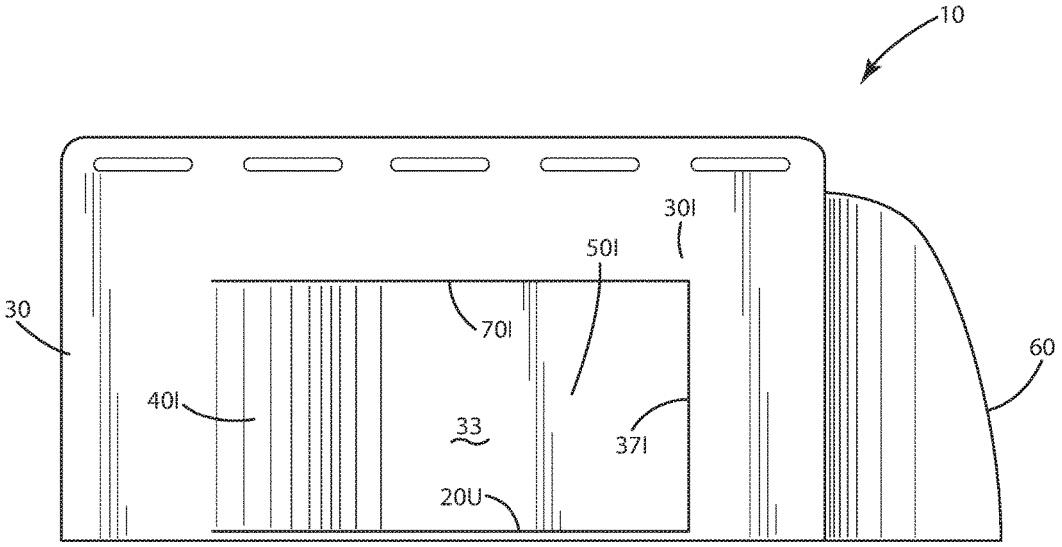
FIG. 7 is a left side view of the kick out flashing.
Figure 8:
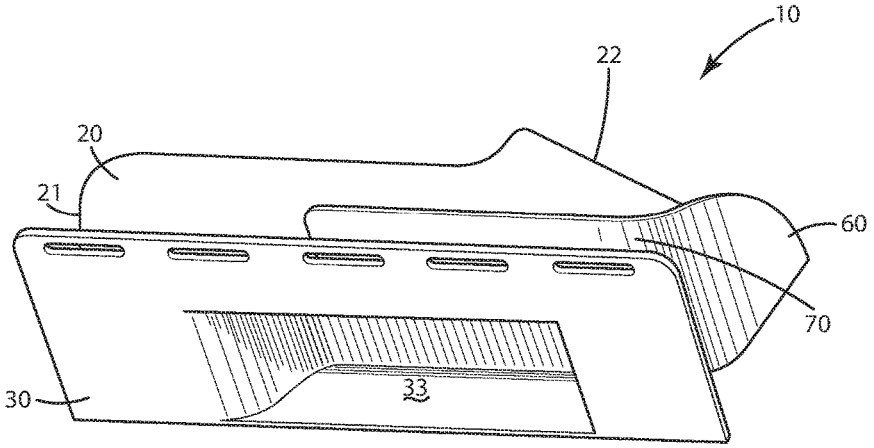
FIG. 8 is a left side perspective view of the kick out flashing.

As shown in FIGS. 1, 2, 6 and 7, the sidewall 30 can extend upwardly, generally perpendicular to the base 20. The sidewall 30 can include, as mentioned above, a fastener flange 31, also referred to as a nailing flange, defining a plurality of slots or openings 310. The sidewall 30 can include an exterior 30E in an interior 301. The interior 301 can face toward the wall 3 of the structure 1. The interior 301, as shown in FIG. 7, can define a recess 33. This recess 33 can extend under the bottom wall 71 of the channel 70. This recess 33 can be bounded by an interior surface 711 of that bottom wall 71, an interior surface 401 of the first kick out wall 40, an interior surface 501 of the intermediate wall 50, and an interior surface 371 of a drop wall 37. Optionally, the recess 33 also can be bounded by an upper surface 20U of the base, which optionally extends under the recess. Of course in other cases, that base may not extend under or form a portion of the recess 33. Recess 33 can correspond to and mirror the corresponding components, walls and structures adjacent the exterior 30E of the sidewall and of the flashing in general.

As shown, the recess 33 can extend under the bottom wall 71 such that water cannot escape from the channel 70 and drip down into the recess. The recess 33 can be disposed under the channel 70, but not in communication with water traveling along the water path WP. There optionally are no openings or pathways through the walls on the exterior of the sidewall that can facilitate penetration of water into that recess 33. In other constructions, the recess can be closed off and/or filled with another material, depending on the application.

As shown in FIG. 2, the sidewall 30 includes the fastener flange 31. This flange can extend to a starter flange 33. The flange 31 can extend upward from adjacent the bottom wall 71. Opposite the flange 31 can be a secondary portion 52 of the intermediate wall 50, which also can extend upward and above the bottom wall 71. This secondary portion 52 optionally can be parallel to the sidewall. The primary portion 51 of the intermediate wall 50, below the secondary portion 52, also can be parallel to the sidewall, and located below the bottom wall 71 and channel 70. Collectively, the secondary portion 52 of the intermediate wall, the exterior 30E of the sidewall 30 and the bottom wall 71 can form the channel 70. This channel can be sized and configured to receive a J channel J within it in such a manner that the J channel J is held distance above the base 20 and effectively above the first kick out wall 40.

Figure 5:
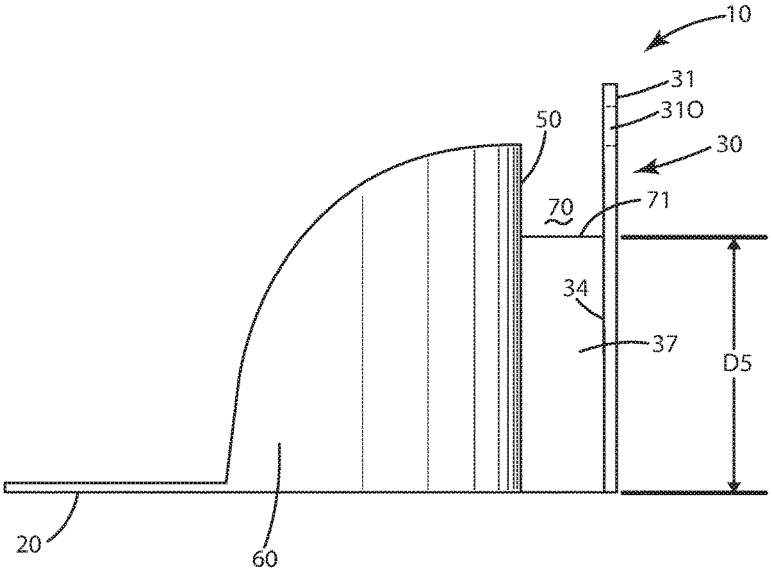
FIG. 5 is a front view of the kick out flashing.

As shown in FIGS. 2, 3 and 5, the sidewall 30 can transition to the bottom wall 71. It also can transition to the first kick out wall 40, as well as the drop wall 37 disposed at the downstream end of the channel 70. The sidewall 30 optionally can extend beyond the drop wall 37 a predetermined distance D4, forming an end flange 34. This distance can be about ¼ inch to 2 inches or more or less depending on the application. The bottom wall 71 also can transition to the drop wall 37. The drop wall 37 can be generally vertical or optionally at a slight angle to horizontal to facilitate cascading of water out from the channel 70 beyond the outermost edge 6 of the roof deck 2. The drop wall 37 can extend downward from the bottom wall 71 a distance D5 (FIG. 5) that is substantially equal to a height H1 (FIG. 4) of the first kick out wall 40. The drop wall 37 can be optionally perpendicular to the sidewall 30. The drop wall 37 also optionally can be disposed in a different angle than the first kick out wall 40 and the second kick out wall 60 relative to the sidewall 30. For example, the drop wall 37 can be perpendicular to the sidewall, while the first and second kick out walls can be offset at one or more obtuse angles relative to the sidewall, and optionally to the intermediate wall.

Optionally, the bottom wall 71 can be substantially parallel to the base 20. In certain applications, however, the bottom wall 71 can be angled relative to the base, for example, angled downward so that the end of the bottom wall 71 closer to the end flange 34 is closer to the base than the end of the bottom wall 71 adjacent the starter flange 33. This can facilitate water flow down the drop wall 37 on flatter roofs.

With reference to FIG. 3, the sidewall 30 can transition to the first kick out wall 40. The first kick out wall 40 can be offset at a first angle A1 relative to the sidewall 30. The intermediate wall 50 can be generally parallel to sidewall. The second kick out wall can be offset at a second angle A2 relative to the intermediate wall 60 and similarly to the sidewall 30 as shown in FIG. 3. In some applications, these angles A1, A2 can be configured to kick out and divert the water along the water path any suitable manner. For example, first angle A1 and the second angle A2 optionally each can be obtuse angles. As a further example, the angles can be greater than 90°, optionally between 91° and 180°, further optionally between 120° and 150°, yet further optionally between 110° and 160°. Of course, other obtuse angles can work as well. In some cases, the first angle can be greater than the second angle. In other cases, the first angle can be substantially equal to the second angle. In yet other cases, the second angle can be greater than the first angle. As illustrated, the first angle A1 is greater than the second angle A2.

The first kick out wall 40 can be at the obtuse angle first angle A1, again generally to divert water away from the sidewall 30 and prevent the water from flowing under the channel 70 and/or the bottom wall 71. The first kick out wall 40 can be upstream of the channel 70, closer to the upstream end 21 of the base than the channel 70. The first kick out wall 40 can transition to the bottom wall 71 and the channel at the channel interface 41. This interface can also be disposed at the angle A1 mentioned above relative to the sidewall 30. The first kick out wall 40 can be located below the bottom wall 71 of the channel 70 and can divert water away from the sidewall 30 so that water does not flow for any distance directly under the channel 70, nor directly under or beneath the bottom wall 71. In this manner, water traveling along the water path WP, guided by the kick out flashing, does not extend under the channel 70 or under the bottom wall 71. Instead, the water is diverted by the kick out wall 40 away from the sidewall and the channel 70.

As mentioned above, the first kick out wall 40 can transition to the intermediate wall 50. This transition can be a gradual and uninterrupted rounded contour 40C, forming a smooth transition for water to travel along the water past WP. Generally, when the water travels along the water path WP, the first kick out wall 40 can diverge water immediately adjacent the sidewall 30, a distance D1 from that sidewall, which can be in contact with that sidewall, outward along the face of the first kick out wall 40, such that the water then travels at a first distance D2 away from the sidewall 30. Optionally, the intermediate wall 50 can be offset and/or spaced away from the sidewall this distance D2 as well.

The intermediate wall 50 can be formed so that it is taller than the first kick out wall 40. Indeed, as mentioned above, the secondary portion 52 of the intermediate wall 50 can extend above the bottom wall 71, while the first kick out wall 40 only extends substantially below the bottom wall 71 of the channel 70. In some cases, the secondary portion 52 of intermediate wall 50 can extend upward, so that it can cover a portion of the J channel J (FIGS. 4, 6). Optionally, however the intermediate wall 50, however, is not as tall as the sidewall 30, such that the top 50T of the intermediate wall 50 is lower than the top 30T of the sidewall 30. In some cases, the bottom wall can be lower than the top 50T of the intermediate wall 50, and that top 50T can be between the bottom wall 71 and the top 30T of the sidewall 30. Optionally, with the top 30T and nailing flange 31 higher than or above the top 50T of the intermediate wall 50, an installer can install fasteners such as nails through the apertures 310 in the sidewall 30 and nailing flange 31 without damaging the intermediate wall 50.

With reference to FIGS. 1-3, the intermediate wall 30 can extend from the first kick out wall 40 to the second kick out wall 60, and in doing so can be substantially parallel to the sidewall 30. Of course, in certain applications, the intermediate wall can be slightly offset at another obtuse angle relative to the sidewall 30. The intermediate wall 50 can be distal from, and offset from, the sidewall 30 the distance D2 or some other distance. This distance D2 optionally can be the width of the channel. In some cases, the distance D2 can be optionally ½ inch, further optionally 1 inch, even further optionally 1.5 inches to 2.0 inches, yet further optionally at least one half inch or other measurements depending on the size of the J channel. The intermediate wall also can be offset an angle A2, which optionally can be obtuse, relative to the second kick out wall 60. Further optionally, all of the first kick out wall 40, intermediate wall 50 and second kick out wall 60 can be substantially vertical and can be perpendicular to the base 20.

The intermediate wall 50 can transition to the second kick out wall 60. The transition can be along a curvilinear and/or angled interface 55 disposed between those two elements. This transition can be a continuous surface or contour extending along the intermediate wall 50 through the interface 55 and to the second kick out wall 60. As mentioned above, the second kick out wall 60 can be closer to the downstream end 22 than the upstream end 21. This second kick out wall 60 can diverge water even farther away from the sidewall and structural wall. For example, it can diverge water along the water path WP a second distance D3 away from the sidewall 30, so the water travels along the water path WP toward the downstream end 22, generally over surfaces of the kick out flashing 10. The second kick out wall 60 optionally may or may not form portion of the channel 70. The second kick out wall 60 also can be disposed a distance D4 beyond the drop wall 37 and generally the channel 70, as shown in FIG. 3. This second kick out wall 60 can be configured such that it extends beyond the lower edge 6 of the roof 2 when installed. This second kick out wall 60 also can be taller than the first kick out wall 40. In some cases, the second kick out wall 60 can be the same height as the intermediate wall, such that it too extends a height above the bottom wall 71. The second kick out wall can be disposed at the angle A2 as mentioned above. It further can be of a shorter height than the overall height of the sidewall.

As mentioned above, the kick out flashing 10 can be configured to be placed adjacent a roof deck 2 and a wall 3 as shown in FIG. 1. It can be installed by advancing fasteners through the nailing flange 31, and, in particular, the fastener openings 310, and connecting the flashing 10 to the wall 3. The base 20 can be placed adjacent the roof deck 2. A secondary flashing 7 can be placed over the upstream end 21 of the base 20 and a portion of the sidewall 30. Shingles (not shown) can be laid over the base 20 and about against the sidewall 30, first kick out wall 40, intermediate wall 50 and perhaps it portion of the second kick out wall 60A. J channel can be installed within the channel 70, above the bottom wall 71 and above the first kick out wall 40.

In operation, when water flows over the shingles and the base of the kick out flashing 10, that water is diverted outward from the wall 3 via the sidewall 30, and the downstream first kick out wall 40 a distance D2. The water flows on the water path WP along the intermediate wall 50 generally parallel to the sidewall at distance D2. The water is then kicked out again via the second kick out wall 60 to the distance D3 away from the wall. In being so kicked out, the water is also directed in direction D away from the wall 3 of structure 1. The water flowing along the water path WP, does not extend substantially under the channel 70 or under the bottom wall 71. The water flowing along the water path WP also is substantially kicked out or diverged twice, optionally incrementally, first a first distance D2 and then a second distance D3 so that the water is gradually diverged from the sidewall 30 and the wall structure 3. Where the second kick out wall 60 and downstream end 22 extend beyond the lower edge 6 of the roof 2, the water is adequately diverged away from the wall 3 extending under that edge 6. Of course, in some applications, the entire flashing 10 can be disposed above the lower edge 6.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A kick out flashing comprising:

a base configured to be placed adjacent a structural roof deck;

a sidewall configured to be placed adjacent a structural wall angled relative to the structural roof deck;

a first kick out wall, disposed at a first obtuse angle relative to, and transitioning to, the sidewall;

an intermediate wall joined with the first kick out wall, distal from the sidewall; and a second kick out wall disposed at a second obtuse angle relative to the intermediate wall, the second kick out wall distal from the sidewall and downstream from the first kick out wall, wherein the sidewall transitions to the base at a sidewall corner, wherein the intermediate wall transitions to the base at an intermediate corner, wherein the first kick out wall transitions to the base at a first kick out wall corner, wherein the second kick out wall transitions to the base at a second kick out wall corner.

2. The kick out flashing of claim 1, wherein the base includes a downstream end and an upstream end, wherein the first kick out wall is closer to the upstream end than the second kick out wall, wherein the first kick out wall is configured to diverge water away from the sidewall a first distance as water travels from the upstream end toward the downstream end, before the water reaches the second kick out wall, wherein the second kick out wall is configured to diverge water away from the intermediate wall a second distance, and away from the structural wall.

3. The kick out flashing of claim 2, wherein the second distance is greater than the first distance.

4. A kick out flashing comprising:

a base configured to be placed adjacent a structural roof deck;

a sidewall configured to be placed adjacent a structural wall angled relative to the structural roof deck;

a first kick out wall, disposed at a first obtuse angle relative to, and transitioning to, the sidewall;

an intermediate wall joined with the first kick out wall, distal from the sidewall; and a second kick out wall disposed at a second obtuse angle relative to the intermediate wall, the second kick out wall distal from the sidewall and downstream from the first kick out wall, wherein the sidewall and the intermediate wall define a channel configured to receive a J channel of siding, wherein the channel is bounded by a bottom wall extending between the intermediate wall and the sidewall, wherein the bottom wall transitions to the first kick out wall at a first channel interface, wherein the first channel interface is disposed generally at the first obtuse angle relative to the sidewall.

5. A kick out flashing comprising:

a base configured to be placed adjacent a structural roof deck;

a sidewall configured to be placed adjacent a structural wall angled relative to the structural roof deck;

a first kick out wall, disposed at a first obtuse angle relative to, and transitioning to, the sidewall;

an intermediate wall joined with the first kick out wall, distal from the sidewall; and a second kick out wall disposed at a second obtuse angle relative to the intermediate wall, the second kick out wall distal from the sidewall and downstream from the first kick out wall, wherein the sidewall and the intermediate wall define a channel configured to receive a J channel of siding, wherein the channel is bounded by a bottom wall extending between the intermediate wall and the sidewall, wherein the first kick out wall extends below the bottom wall, wherein the intermediate wall extends below and above the bottom wall.

6. A kick out flashing comprising:

a base configured to be placed adjacent a structural roof deck;

a sidewall configured to be placed adjacent a structural wall angled relative to the structural roof deck;

a first kick out wall, disposed at a first obtuse angle relative to, and transitioning to, the sidewall;

an intermediate wall joined with the first kick out wall, distal from the sidewall; and a second kick out wall disposed at a second obtuse angle relative to the intermediate wall, the second kick out wall distal from the sidewall and downstream from the first kick out wall, wherein the sidewall forms a first sidewall of a channel, wherein the intermediate wall forms an opposing second sidewall of the channel, wherein a bottom wall transitions to and is joined with the first and second sidewalls.

7. A kick out flashing comprising:

a base configured to be placed adjacent a structural roof deck;

a sidewall configured to be placed adjacent a structural wall angled relative to the structural roof deck;

a first kick out wall, disposed at a first obtuse angle relative to, and transitioning to, the sidewall;

an intermediate wall joined with the first kick out wall, distal from the sidewall; and a second kick out wall disposed at a second obtuse angle relative to the intermediate wall, the second kick out wall distal from the sidewall and downstream from the first kick out wall, wherein the sidewall transitions to the base at a sidewall corner, wherein the intermediate wall transitions to the base at an intermediate corner, wherein the intermediate corner is farther away from the sidewall than the sidewall corner.

8. A kick out flashing comprising:

a base configured to be placed adjacent a structural roof deck;

a sidewall configured to be placed adjacent a structural wall angled relative to the structural roof deck;

a first kick out wall, disposed at a first obtuse angle relative to, and transitioning to, the sidewall;

an intermediate wall joined with the first kick out wall, distal from the sidewall; and a second kick out wall disposed at a second obtuse angle relative to the intermediate wall, the second kick out wall distal from the sidewall and downstream from the first kick out wall, wherein the first kick out wall is of a first height;

wherein the second kick out wall is of a second height that is greater than the first height.

9. A kick out flashing comprising:

a base configured to be placed adjacent a structural roof deck;

a sidewall configured to be placed adjacent a structural wall angled relative to the structural roof deck;

a first kick out wall, disposed at a first obtuse angle relative to, and transitioning to, the sidewall;

an intermediate wall joined with the first kick out wall, distal from the sidewall; and a second kick out wall disposed at a second obtuse angle relative to the intermediate wall, the second kick out wall distal from the sidewall and downstream from the first kick out wall, wherein the first kick out wall transitions to the intermediate wall, the intermediate wall being substantially parallel to the sidewall and distal from the sidewall, wherein the intermediate wall transitions to the second kick out wall, wherein the intermediate wall is taller than the first kick out wall, wherein the intermediate wall and the sidewall and a bottom wall define a channel, the channel configured to receive a siding J channel, wherein the base includes an upstream end and a downstream end, wherein the first kick out wall is closer to the upstream end than the downstream end, wherein the second kick out wall is closer to the downstream end than the upstream end.

10. A kick out flashing comprising:

a base configured to be placed adjacent a structural roof deck, the base including an upstream end and a downstream end;

a sidewall configured to be placed adjacent a structural wall that is angled relative to the structural roof deck;

a first kick out wall joined with the sidewall;

an intermediate wall joined with the first kick out wall, distal from the sidewall; and a second kick out wall joined with the intermediate wall, the second kick out wall distal from the sidewall, wherein the first kick out wall is closer to the upstream end than the downstream end, wherein the second kick out wall is closer to the downstream end than the upstream end, wherein the intermediate wall and the sidewall and a bottom wall define a channel, the channel configured to receive a siding J channel, whereby the first kick out wall diverges water a first distance away from the sidewall, and the second kick out wall diverges water a second distance away from the sidewall when water travels toward the downstream end generally over the kick out flashing.

11. The kick out flashing of claim 10, wherein the first kick out wall is located below the bottom wall and configured to divert water away from the sidewall so that the water does not flow for any distance directly beneath the channel, nor directly under the bottom wall.

12. The kick out flashing of claim 10, wherein the first kick out wall is located upstream of the channel.

13. The kick out flashing of claim 10, wherein the intermediate wall includes a primary portion that extends below the bottom wall and is parallel to the sidewall, wherein the intermediate wall includes a secondary portion that extends above the bottom wall and is parallel to the sidewall.

14. The kick out flashing of claim 13, wherein the sidewall includes an exterior surface and interior surface, wherein the interior surface defines a recess bounded by the bottom wall, the intermediate wall, the first kick out wall, the base and a drop wall, wherein the bottom wall transitions to the drop wall, whereby the channel and drop wall are configured so that any water in the channel cascades down the drop wall.

15. The kick out flashing of claim 10 comprising:

a drop wall that extends downward from the bottom wall a first distance, distal from the first kick out wall, wherein the first kick out wall extends downward from the bottom wall a second distance, wherein the first distance and the second distance are substantially equal.

16. The kick out flashing of claim 15, wherein the first kick out wall is offset at a first angle relative to the sidewall, wherein the intermediate wall is generally parallel to the sidewall, wherein the second kick out wall is offset at a second angle relative to the intermediate wall.

17. The kick out flashing of claim 16, wherein the first angle and the second angle are each obtuse angles, wherein the first angle is greater than the second angle.

18. The kick out flashing of claim 10, wherein the intermediate wall extends below the bottom wall, wherein the first kick out wall and the intermediate wall prevent water from traveling directly under the channel.

19. The kick out flashing of claim 18, wherein the sidewall defines a plurality of nailing apertures above the bottom wall.

20. A kick out flashing comprising:

a base;

a sidewall generally perpendicular to the base;

a first kick out wall angled and transitioning away from the sidewall to an intermediate wall, the intermediate wall being substantially parallel to the sidewall, the intermediate wall transitioning to a second kick out wall that is angled away from the intermediate wall, a bottom wall extending away from the sidewall, wherein the sidewall, the bottom wall and the intermediate wall form a channel configured to receive a J channel of siding, wherein the first kick out wall is configured to diverge water away from the sidewall and the channel, wherein the second kick out wall is configured to diverge water away from the intermediate wall downstream of the first kick out wall.

* * * * *